US010436474B2

(12) United States Patent
Duchet et al.

(10) Patent No.: US 10,436,474 B2
(45) Date of Patent: Oct. 8, 2019

(54) MODULE FOR AN AIR HANDLING UNIT AND AIR HANDLING UNIT INCLUDING SUCH A MODULE

(71) Applicant: Carrier Corporation, Farmington, CT (US)

(72) Inventors: Samuel Duchet, Lyons (FR); Marc Serra, Andert et Condon (FR); Bertrand Jacquin, Saint Maximin (FR); Guillaume Montessuit, Saint Pierre en Faucigny (FR)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/555,317

(22) PCT Filed: Mar. 2, 2016

(86) PCT No.: PCT/US2016/020349
§ 371 (c)(1),
(2) Date: Sep. 1, 2017

(87) PCT Pub. No.: WO2016/141010
PCT Pub. Date: Sep. 9, 2016

(65) Prior Publication Data

US 2018/0058716 A1 Mar. 1, 2018

(30) Foreign Application Priority Data

Mar. 5, 2015 (FR) ..... 15 51857

(51) Int. Cl.
*F24F 13/20* (2006.01)
*F24F 13/02* (2006.01)

(52) U.S. Cl.
CPC ..... *F24F 13/20* (2013.01); *F24F 13/0209* (2013.01); *F24F 13/0245* (2013.01)

(58) Field of Classification Search
CPC ..... F24F 13/20; F24F 13/0209; F24F 13/0245
(Continued)

(56) References Cited

U.S. PATENT DOCUMENTS 3,675,379 A * 7/1972 Lambert ..... E04B 1/08 52/264
2009/0059523 A1* 3/2009 Mallia ..... G06F 1/20 361/695
2011/0291533 A1* 12/2011 McFarland ..... F24F 13/20 312/236

FOREIGN PATENT DOCUMENTS

FR 2492498 A3 4/1982
GB 2280951 A 2/1995

OTHER PUBLICATIONS

International Search Report and Written Opinion for application PCT/US2016/020349, dated May 13, 2016, 10pgs.

* cited by examiner

*Primary Examiner* — James O Hansen
(74) *Attorney, Agent, or Firm* — Cantor Colburn LLP

(57) ABSTRACT

The invention relates to a module for an air handling unit, comprising at least one side surface formed by the assembly of several panels arranged next to one another, a connection post (12) between two adjacent panels, including two facing fins (122) for positioning the panels, and two bases (14) for attaching the post (12) to an upper surface and to a lower surface (2), respectively, of the module, these bases being mounted at the two ends of the post. Each base (14) comprises two facing strips (18) which carry, on the interior side of the module, a rectilinear sealing gasket (20) for sealing the space between the fins (122) of the post (12) and the upper surface or lower surface (2) of the module.

18 Claims, 3 Drawing Sheets

Figure 1:
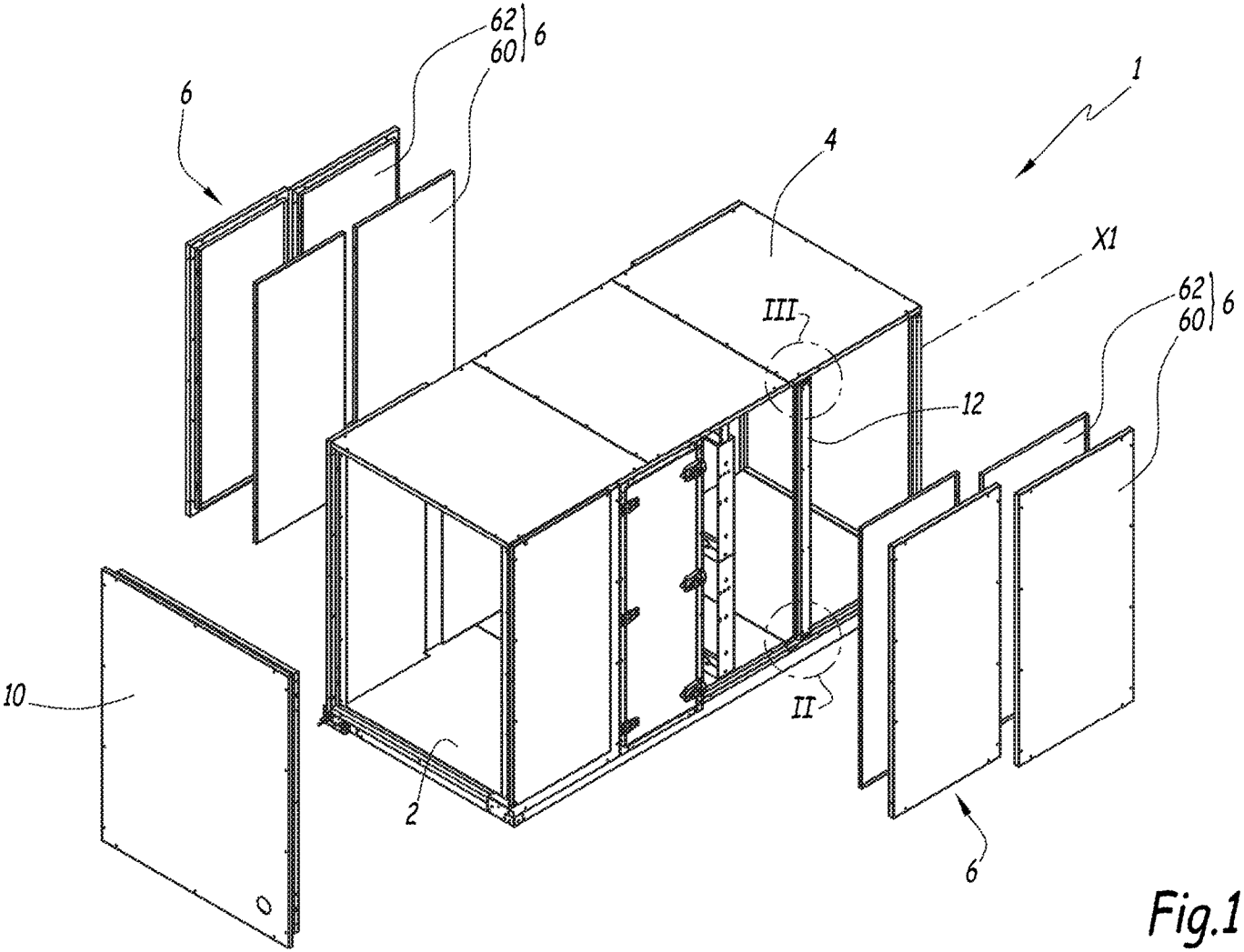

(58) Field of Classification Search
USPC ..... 312/257.1, 265.1, 265.2, 265.3, 265.5, 312/100
See application file for complete search history.

MODULE FOR AN AIR HANDLING UNIT AND AIR HANDLING UNIT INCLUDING SUCH A MODULE

The invention relates to a module for an air handling unit and to an air handling unit including such a module.

In the field of air handling, it is known to use a unit for the renewal and conditioning of air in a building. This unit includes several modules such as a ventilation module, a heat treatment module, a filtration module or also a humidification module.

Each module is in the form of an open, semi-open or closed chamber including two side surfaces formed by the assembly of several panels arranged next to one another. Posts having a T-shaped cross section ensure the mechanical connection between two adjacent panels. These posts include fins for the positioning of the panels. A base is mounted at each end of a post. This base makes it possible to attach the post to the upper surface or to the lower surface of the module.

To prevent air leaks at the connection posts, it is known to arrange a bead of sealant in the space between the lower or upper panel and the fins of the posts. The placement of this bead is expensive, since it takes place during the assembly of the unit. In addition, the sealant deteriorates rapidly over time and it is not an ecological product.

These are the disadvantages that the invention aims to overcome more particularly by proposing a module for an air handling unit in which the seal between the fins of the connection posts and the upper or lower surface of the module is produced more economically and lastingly.

For this purpose, the invention relates to a module for an air handling unit, including:

- at least one side surface formed by the assembly of several panels arranged next to one another,
- a connection post between two adjacent panels, including two facing fins for positioning the panels, and
- two bases for attaching the post to an upper surface and to a lower surface, respectively, of the module, these bases being mounted at the two ends of the post.

According to the invention, each base comprises two facing strips which carry, on the interior side of the module, a rectilinear sealing gasket for sealing the space between the fins of the post and the upper surface or the lower surface of the module.

By means of the invention, the sealing function between the fins of the posts and the upper or lower surface of the module is incorporated directly into the base. Therefore, the installer does not need to add a bead of sealant below or above the fins of each post.

According to advantageous but nonobligatory aspects of the invention, the module can have one or more of the following features, considered in any technically acceptable combination:

- The sealing gasket of each strip is compressed between the strip and a rim formed on the upper surface or on the lower surface of the module.
- The sealing gasket of each strip is attached on a first portion of the strip, while a second portion of the strip bears against an end of the fins of the post.
- Each base delimits at least one recess for the passage of a screw for attaching the base to the rim of the upper surface or of the lower surface of the module.
- Each base delimits two recesses for the passage of screws.
- Each post is an aluminum profile having a T-shaped cross section.

- Each post comprises a hollow portion in which the bases are fit.
- Each base is made of plastic material.
- The adjacent panels bear against the exterior wall of the fins of the post.

The invention also relates to an air handling unit including a module as described above.

Figure 2:
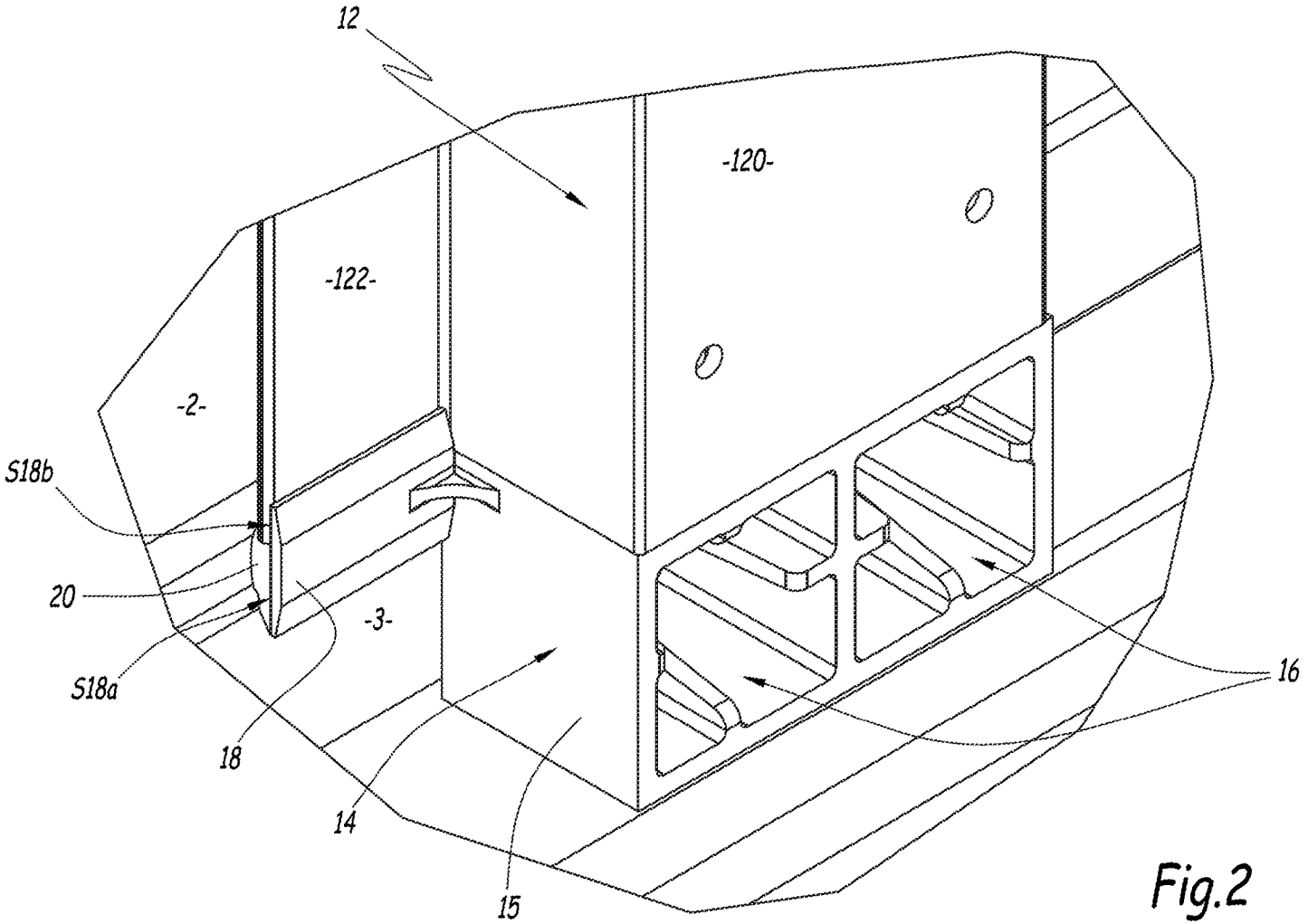
Figure 3:
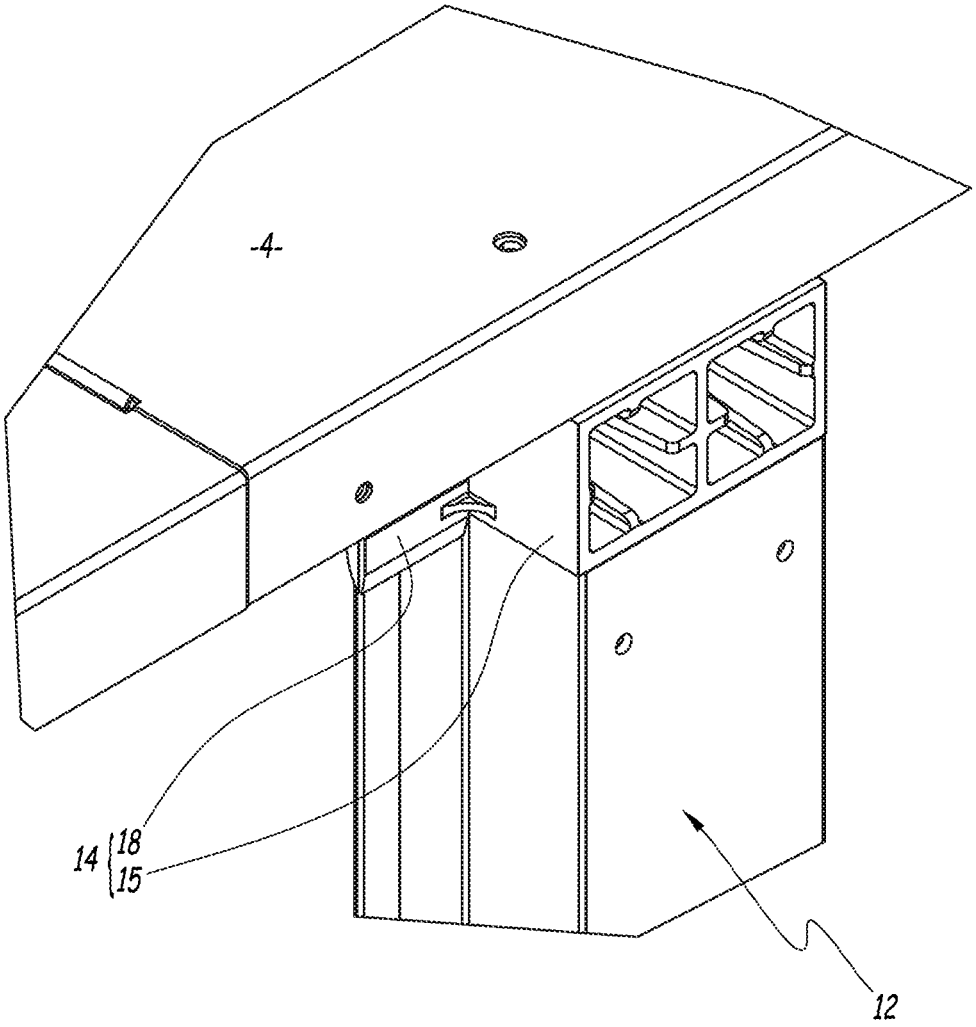

The invention and other advantages of said invention will become clearer in the light of the following description of an embodiment of a module for an air handling unit which is in accordance with its principle, given only as an example and in reference to the appended drawings in which:

FIG. 1 is an exploded perspective view of a module for an air handling unit according to the invention, FIG. 2 is a view on a larger scale of the circled portion 2 of FIG. 1, and FIG. 3 is a view on a larger scale of the circled portion 3 of FIG. 1.

In FIG. 1, a module 1 is represented for an air handling unit that is not represented. This module 1 is a chamber having a rectangular cross section extending along a longitudinal axis X1. The axis X1 defines an axis of passage of the air in the module 1. The module 1 includes two longitudinal end surfaces, that is to say which are perpendicular to the longitudinal axis X1, of which one surface is closed by a panel 10, while the other surface is open. The module 1 also includes a lower panel 2 forming a lower surface and an upper panel 4 forming an upper surface of the module 1. The upper surface and the lower surface are arranged parallel to one another. The module 1 also includes side surfaces formed by the assembly of panels 6 arranged next to one another. The two side surfaces are parallel to the longitudinal axis X1. Each panel 6 includes an exterior plate 62, an interior plate 60, and a layer of insulating material, not shown, which is inserted between the two plates 60 and 62.

In the present document, the orientations "interior" and "exterior" should be interpreted relative to the internal volume of the module, that is to say the volume of circulation of the air inside the module 1.

On its two side surfaces, the module 1 includes posts 12 for ensuring the mechanical connection between two adjacent panels 6. These posts 12 ensure the mechanical strength of the module 1. Each post 12 is an aluminum profile having a T-shaped cross section, which is attached to the upper surface 4 and to the lower surface 2 by attachment bases 14. Each connection post 12 extends perpendicularly to the surfaces 2 and 4 and includes a hollow portion 120 having a rectangular cross section, in which the bases 14 are fit, and two side fins 122 which extend over the entire height of the post 12 and which are parallel to the axis X1. The bases 14 are mounted at the ends of each post 12. The fins 122 make it possible to position the panels 6. In an assembled configuration of the module 1, the panels 6 bear against the fins 122 on the exterior side.

The bases 14 are made of plastic material and each include a body 15 having a rectangular cross section, which is partially pressed into the hollow portion 120 of each post 12. The bases 14 are attached against a rim 3 formed on the lower surface 2 or on the upper surface 4, respectively. Each rim 3 forms a step perpendicular to the rest of the surface 2 or 4. The rim 3 of the lower surface 2 is visible in the viewing angle of FIG. 2, while the rim of the upper surface 4 is not visible in the viewing angle of FIG. 3. In the assembled state of the module 1, the side panels 6 are arranged against the rims 3.

The bases 14 each delimit two rectangular recesses 16 for the passage of attachment screws which are not represented.

These screws have the function of firmly connecting the base 14 to the rim 3 formed on the upper surface 4 or on the lower surface 2. The recesses 16 thus extend perpendicularly to the rims 3 of the surfaces 2 and 4.

Each base 14 includes two strips 18 which extend from the body 15 and parallel to the axis X1 in two opposite directions. The strips 18 are as wide as the fins 122 of the post 12 to which the base 14 belongs, this width being measured parallel to the axis X1. On the interior side, the strips 18 carry a rectilinear sealing gasket 20 for sealing the space between the fins 122 of the post 12 and the upper surface 4 or the lower surface 2 of the module. This gasket 20 extends parallel to the axis X1. In the assembled state, the sealing gasket 20 of each strip 18 is compressed between the strip 18 and the rim 3 formed on the lower surface 2 or on the upper surface 4 or of the module. As can be seen in FIG. 2, the sealing gasket 20 of each strip 18 is attached on a first portion S18*a* of the strip 18, while a second portion S18*b* of the strip 18 bears against an end of the fins 122 of the post 12. The strips 18 thus cover the two ends of the exterior wall of the fins 122.

The sealing gaskets 20 then prevent leakage or infiltration of air above and below the fins 122 of each post 12, such infiltration of air being potentially detrimental to the proper operation of the unit.

In a variant which is not represented, the module 1 is a reinforced model in which the lower panel and the upper panel are framed in a framework made of aluminum, for example. The bases 14 are then screwed directly in the framework of the panels 2 and 4.

The features of the variants and embodiments considered above can be combined with one another to generate new embodiments of the invention.

The invention claimed is:

1. Module for an air handling unit, including:

at least one side surface formed by an assembly of several panels arranged next to one another, a connection post between two adjacent panels, including a hollow portion having a rectangular cross section and two side fins for positioning the panels, and two bases for attaching the post to a top wall and to a bottom wall, respectively, of the module, these bases being mounted at the two ends of the post;

wherein each base includes a body having a rectangular cross section and comprises two strips which carry, on the interior side of the module, a rectilinear sealing gasket for sealing the space between the fins of the post and the top wall or bottom wall of the module;

wherein, for each base, the two strips extend from the body of the base in two opposite directions.

2. Module according to claim 1, wherein the sealing gasket of each strip is compressed between the strip and a rim formed on the top wall or on the bottom wall of the module.

3. Module according to claim 2, wherein the sealing gasket of each strip is attached on a first portion of the strip, while a second portion of the strip bears against an end of the fins of the post.

4. Module according to claim 2, wherein each base delimits at least one recess for the passage of a screw for attaching the base to the rim of the top wall or of the bottom wall of the module.

5. Module according to claim 4, wherein each base delimits two recesses for the passage of screws.

6. Module according to claim 1, wherein each post is an aluminum profile having a T-shaped cross section.

7. Module according to claim 1, wherein each post comprises the hollow portion in which the bases are fit.

8. Module according to claim 1, wherein each base is made of plastic material.

9. Module according to claim 1, wherein the adjacent panels bear against the exterior wall of the fins of the post.

10. Air handling unit, wherein it includes a module according to claim 1.

11. Module according to claim 1, wherein the fins extend outwardly from the connection post and the strips of each base extend outwardly from the base.

12. Module according to claim 1, wherein the fins and the strips are aligned with a rim perpendicular to the top wall or of the bottom wall of the module.

13. Module according to claim 12, wherein the strips are located between the rim and the fins.

14. Module according to claim 1, wherein the side fins extend over the entire height of the post.

15. Module according to claim 1, wherein the strips of each base are as wide as the fins of the post.

16. Module according to claim 1, wherein the body of each base is partially pressed into the hollow portion of the post.

17. Module according to claim 1, wherein the post is an aluminium profile.

18. Module according to claim 1, wherein the two strips extend from the body of the base in parallel directions.

* * * * *